United States Patent [19]

Bruno et al.

[11] 4,413,725

[45] Nov. 8, 1983

[54] POTTED PLANT PACKAGE

[76] Inventors: Edward D. Bruno, 1880 S. Monaco Pkwy., Denver, Colo. 80202; Gary C. Bruno, 3132 S. Norfold St., Aurora, Colo. 80802

[21] Appl. No.: 447,205

[22] Filed: Dec. 6, 1982

Related U.S. Application Data

[63] Continuation of Ser. No. 280,212, Jul. 6, 1981, abandoned.

[51] Int. Cl.[3] ..... B65D 85/50; B65D 85/52

[52] U.S. Cl. ..... 206/45.33; 206/423; 206/459; 206/627; 229/87 P

[58] Field of Search ..... 206/423, 216, 45.33, 206/497, 459, 627, 628; 229/87 P

[56] References Cited

U.S. PATENT DOCUMENTS

| | | | |
|---|---|---|---|
| 583,925 | 6/1897 | McGowan | 206/423 |
| 1,801,387 | 4/1931 | Routman | 206/423 |
| 2,150,453 | 3/1939 | Mulford et al. | 206/423 |
| 2,736,138 | 2/1956 | Buttery | 206/423 |
| 3,021,046 | 2/1962 | Pullen | 206/423 |
| 3,144,932 | 8/1964 | Zerbo, Jr. | 206/423 |
| 3,657,840 | 4/1972 | Benoist | 206/423 |
| 3,869,828 | 3/1975 | Matsumoto | 206/423 |
| 4,014,134 | 3/1977 | Womack, Jr. | 206/423 |
| 4,216,620 | 8/1980 | Weder et al. | 206/423 |

*Primary Examiner*—Joseph Man-Fu Moy
*Attorney, Agent, or Firm*—Leo J. Aubel

[57] ABSTRACT

A potted plant package for protecting the flowers and plants during transit, with a part of said package being removable for forming an attractive display, such as for a gift.

2 Claims, 6 Drawing Figures

POTTED PLANT PACKAGE

REFERENCE TO RELATED APPLICATION

This is a request for filing a continuation application of the pending prior application, Ser. No. 280,212, filed July 6, 1981 now abandoned.

BACKGROUND OF INVENTION

Wrappings for potted plants for handling and/or shipment are, of course, well-known in the art. French Pat. No. 2,036,163, Belgian Pat. No. 654,427, German Pat. No. 1,166,692 and U.S. Pat. Nos. 3,052,063 and 3,869,828 show various different types of such wrappings for potted plants.

SUMMARY OF INVENTION

The present invention provides a potted plant package, which includes a decorative sheet held in position by a clear flexible sleeve. Additionally, the package includes a ribbon affixed to a message card, which card and ribbon are positioned between the sleeve and the pot to provide an attractive package, such as for a gift.

The features and advantages of the present invention will be apparent from the following more particular description of the invention. The accompanying drawings, listed hereinbelow, are useful in explaining the invention wherein:

DESCRIPTION OF INVENTION

Figure 1:
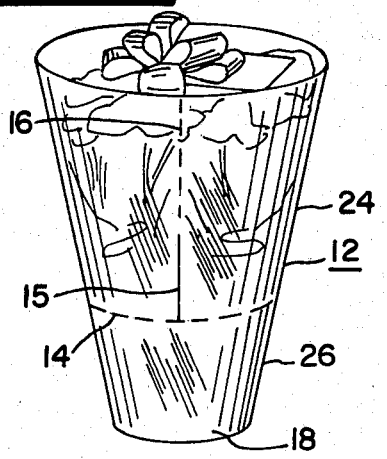
FIG. 1 is a side view of a wrapping assembly, in accordance with the present invention, with a sleeve placed around the potted plant.

Refer first to FIG. 1, which shows a flexible bag or sleeve 12, such as of polyethylene plastic, in accordance with the invention. The bag or sleeve 12 will initially comprise a flexible flat collapsed piece of material which is openable into the form of a tube or sleeve. The sleeve 12 may be tapered outwardly from the lower end toward a larger diameter at its upper end and substantially in a frusto-conical form to conform, when opened, to the associated pot 18. The sleeve 12 includes a circumferentially extending perforated line 14. A vertical slot 15 extends upwardly from the perforated line 14 for approximately three inches; and a second perforated line 16 extends upwardly from the top end of the slit 15 to the top edge of sleeve 12. The purpose of the perforated lines 14 and 16, and of the slit 15, will be explained hereinbelow.

As shown in FIG. 1, sleeve 12 is opened, drawn up and placed around a pot 18, containing a plant whose flowers 20 extend upwardly above the pot. In assembly, the plant pot 18 is centrally placed on a decorative sheet 25 (to be explained); and the sheet is wrapped upwardly around the pot. Next, the sleeve 12 is pulled up around the sides of pot 18 until the lower portion 24 of the sleeve is snugly fitted thereon to form the package, such as indicated in FIG. 1. The upper portion 26 of sleeve 12 encircles and protects the flowers; and the lower portion 24 of the sleeve 12 tightly encircles the pot 18 to retain a decorative sheet 25 in position, as will be explained.

After the potted plant reaches its destination, it is desirable to remove the upper portion 26 of the sleeve 12 in order to arrange the plant in an attractive manner. Accordingly, the upper portion 26 of the sleeve 12 is separated from the lower portion 24 of the sleeve to exhibit or display the flowers. The lower portion 24 of the sleeve 12 remains in position around the pot 18.

Figure 2:
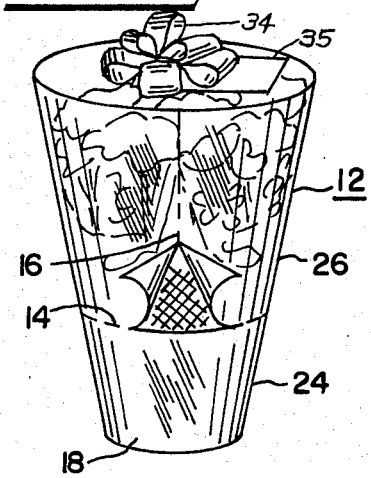
FIG. 2 shows the sleeve of FIG. 1 and indicates the initial tear-away of the sleeve.
Figure 3:
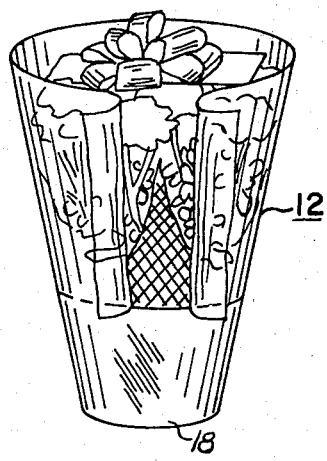
FIG. 3 shows the upper portion of the sleeve being removed from the bottom portion of the sleeve.
Figure 4:
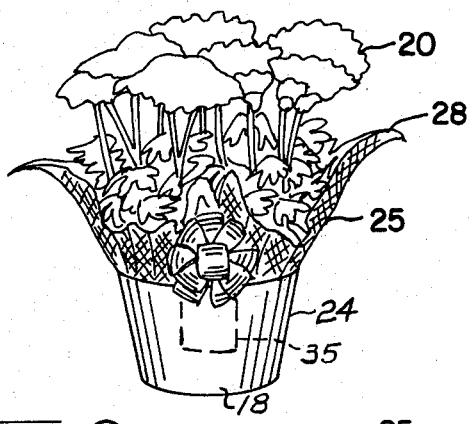
FIG. 4 shows the pot as it appears after the upper portion of the sleeve has been removed, with the decorative sheet held in position by the clear plastic sleeve and the message card with the ribbon also being held by the sleeve.

The upper portion 26 of sleeve 12 is removed, such as by inserting the handler's finger into the slit 15 and pulling out the edges of the slit, causing a tear along the perforated lines 14 and 16, as depicted in FIGS. 2 and 3. After the upper portion 26 of the sleeve 12 is removed, the flowers 20 and edges or ruffles 28 of the decorative sheet 25 are loosened by hand; and the plant is ready for display. As can be seen in FIG. 4, the lower portion of sleeve 12, which is of a transparent material, remains around the pot 18 to hold the decorative sheet 25 in position and in visual display.

Figure 6:
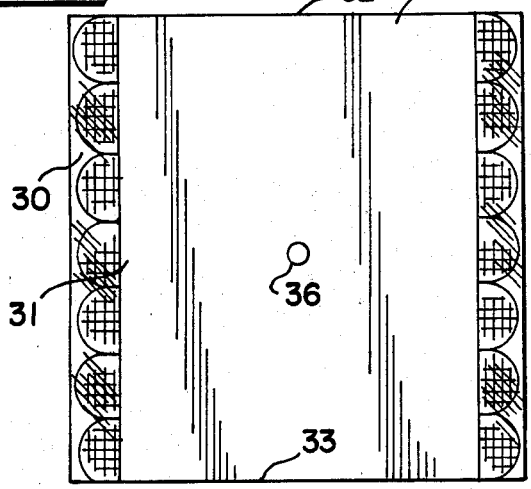
FIG. 6 is a plan view of the decorative sheet referred to above.

The embodiment of the decorative sheet 25 shown in FIG. 6 comprises a lamination of a printed polyethylene plastic 30, to which a silver-colored plastic 31 is selectively bonded, such as along the two edges 32 and 33. The sheet 25, being of two different patterns, provides a very appealing and attractive background for the flowers. A water drainage hole 36 is formed in the center of sheet 25. Any number of colors or different decorations can be used on the decorative sheet 25; and the decoration will be completely visible through the clear plastic.

Figure 5:
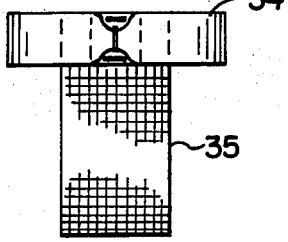
FIG. 5 is a plan view of the message card and ribbon.

A ribbon 34 and message or greeting card 35, indicated in FIG. 5, are included with the potted plant, as in FIGS. 1, 2 and 3. The ribbon 34, which may be of a paper material, may initially be formed as a number of overlaid loops, as is known, and suitably clipped onto card 35, as shown in FIG. 5. For display purposes, the overlaid loops are separated and formed to spread attractive bows, as shown in FIGS. 1, 2 and 3.

The message or greeting card 35 may be rectangularly shaped and has a desired pattern or picture on one side, as indicated in FIG. 5. The card 35 may be at least partially blank on the opposite side, such as for writing a greeting, message and/or signature thereon. In use for presentation as a gift, the card 35 is prepared, as stated; and the ribbon 34 is formed into bows. Next, card 35 is inserted between the clear plastic sleeve 12 and the sheet 25, with the ribbon 34 facing outwardly, as shown in FIG. 4, to thus provide an attractive gift package.

Note also that, if the potted plant package is to be prepared for display in a house and protection of the flowers, such as for shipment, is not required, the upper portion 26 of the sleeve 12 may be removed prior to placing the sleeve 12 around the pot 18. Thus, only the lower portion 24 of sleeve 12 will be assembled around the pot 18, as shown in FIG. 4.

While the invention has been particularly shown and described with reference to a preferred embodiment thereof, it will be understood by those skilled in the art that various changes in form and details may be made therein without departing from the spirit and scope of the invention.

We claim:

1. A package for a pot containing a plant comprising, in combination, an initially flat decorative sheet, said sheet being of such a flexibility and pliability that it will wrap and form around said pot but will not stay around said pot without additional support, a flexible tubular sleeve made of collapsible material openable into said sleeve, said sleeve being positionable around the pot to snugly encircle said sheet and pot and being the sole means of holding the sheet in position around the pot, portions of said sheet extending upwardly from said sleeve to form a decorative background for the plant, and a message card positioned between said transparent sleeve and said decorative sheet to be held in slideable and retractable position by said sleeve, whereby an attractive plant package is provided, wherein said sleeve has an upper portion for protecting the potted plant such as during shipment and which is removable from the pot in situ and a lower portion which remains around the pot to hold the sheet and card in position, and a ribbon mounted on said card, said card being positionable with the card and ribbon straddling said sleeve, and with the ribbon facing outwardly.

2. A package as in claim 1, wherein said sleeve is of clear plastic for allowing display of said sheet.

* * * * *